US006152654A

United States Patent [19]

Ruiz et al.

[11] Patent Number: 6,152,654

[45] Date of Patent: Nov. 28, 2000

[54] APPARATUS FOR MOUNTING POWER CYLINDERS FOR DRIVING PIERS

[75] Inventors: Richard Dean Ruiz, Des Peres; Stephen E. Schmidt, Hillsboro; Troy Dean Ruiz, St. Louis; Scott Allen Ruiz, Kirkwood, all of Mo.

[73] Assignee: Richard D. Ruiz, LLC, St. Louis, Mo.

[21] Appl. No.: 09/337,598

[22] Filed: Jun. 21, 1999

[51] Int. Cl.[7] ..... E02D 11/00; E02D 13/00; E02D 7/00

[52] U.S. Cl. ..... 405/232; 405/229; 405/230

[58] Field of Search ..... 405/229, 230, 405/232, 248

[56] References Cited

U.S. PATENT DOCUMENTS

| | | | |
|---|---|---|---|
| 2,982,103 | 5/1961 | Revesz et al. . | |
| 3,763,654 | 10/1973 | Matsushita . | |
| 3,796,055 | 3/1974 | Mahony . | |
| 3,992,890 | 11/1976 | Pryke . | |
| 4,405,115 | 9/1983 | Boyadjieff . | |
| 4,673,315 | 6/1987 | Shaw et al. . | |
| 4,678,373 | 7/1987 | Langengach, Jr. . | |
| 4,695,203 | 9/1987 | Gregory . | |
| 4,765,777 | 8/1988 | Gregory . | |
| 4,854,782 | 8/1989 | May | 405/230 |
| 4,925,345 | 5/1990 | McGown, Jr. et al. . | |
| 5,006,015 | 4/1991 | Stephens et al. | 405/229 |
| 5,135,335 | 8/1992 | Stephens et al. | 405/229 |
| 5,154,539 | 10/1992 | McCown, Sr. et al. | 405/230 |
| 5,205,673 | 4/1993 | Bolin et al. | 405/230 |
| 5,213,448 | 5/1993 | Seider et al. | 405/230 |
| 5,722,798 | 3/1998 | Gregory | 405/230 |
| 5,800,094 | 9/1998 | Jones | 405/230 |

*Primary Examiner*—James A. Lisehora
*Assistant Examiner*—Alexandra K. Pechhold
*Attorney, Agent, or Firm*—Greensfelder, Hemker & Gale, P.C.

[57] ABSTRACT

An improvement for use with a pier installation apparatus of the type employed in lifting and supporting a foundation is provided. The invention comprises a mounting beam assembly for mounting hydraulic power cylinders in a straddling position around a pier to be driven into the ground by the installation apparatus. The beam assembly is a planar member having a central opening for receiving the pier therethrough. It is comprised of opposing plate members upon which the hydraulic cylinders are mounted. The plate members each have an opening which allows passage through of the piston rod of the hydraulic cylinder. The mounting beam assembly allows for lateral placement around a pier in the installation apparatus, and may be completely disassembled for quick and efficient installation and removal.

16 Claims, 6 Drawing Sheets

APPARATUS FOR MOUNTING POWER CYLINDERS FOR DRIVING PIERS

BACKGROUND OF THE INVENTION

The present invention is broadly concerned with apparatuses for raising and supporting a shallow footing or foundation that has settled due to inadequate compaction of soil and other fill material due to erosion, soil consolidation, dehydration, or other causes. Various piering systems are currently in use for this purpose, and utilize piers of varying configuration and materials including wood, concrete, reinforced concrete, steel pipe, and steel bar stock. A pier is installed underneath or adjacent to a failed footing, and then the load of the footing is transferred to the installed pier by a bracket or load transfer device that is attached to the footing.

This invention deals specifically with a method and apparatus to be used for the installation of pipe piers. In the current art, a pipe pier is advanced into the ground using hydraulic driving cylinders, such as jacks, until a predetermined resistance against the pier is met. The pier is then terminated at an elevation that will allow a foundation load to be transferred to it via a bracket or load transfer mechanism connected to the foundation.

Pipe pier installation apparatuses utilize either single or dual cylinder assemblies are typically used, whereby pier sections are added, section by section, as the pier is advanced into the ground. The depth to which a pier can be advanced is dictated by soil conditions, the driving force of the hydraulic cylinder(s), and the overall strength of the installation assembly.

Single cylinder installation assemblies push piers into the ground, with the piston rod pushing directly on top of the pier, while dual cylinder assemblies are typically inverted, utilizing a reaction to their driving force to pull the pier. One drawback of the single cylinder system is driving force. To develop enough driving force to push piers through dense soils, a single cylinder will either require a prohibitively large diameter, or an additional strength requirement to accept higher hydraulic pressures. The larger diameter cylinder becomes more awkward to handle in the field, and more prone to leakage. The use of high-pressure cylinders increases weight, which again makes the apparatus more cumbersome in the field, and requires larger and costlier hydraulic motors. Another shortfall of the single cylinder, push pier apparatuses currently in use is that they limit the length of pier sections that can be driven. For a single cylinder to be used in driving a pier, it must be concentrically positioned above the pier. This limits pier section lengths to the height inside the apparatus less the space taken up by the mounted cylinder, which impedes installation by requiring the constant insertion and removal of spacers.

Dual cylinder assemblies are more frequently used, as they resolve many of the problems attendant with single cylinder systems. The dual cylinders straddle the pier sections, and thus the pier sections are not limited in length by the available distance above the top of the pier within the installation assembly. Present art pertaining to dual cylinder assemblies often utilizes inverted cylinders that pull the pier into the ground as piston rods are retracted into the cylinders. In this arrangement, the pressurized cylinder chambers used in driving the pier contain the piston rods. As hydraulic fluid is pumped into the cylinders, it cannot act against the entire surface area of the pistons, as some of the available area is taken up by the piston rods. The chambers absent of the piston rods are pressurized during the backstroke, to position the apparatus for the next advancement. The cylinders are therefore not being used in their most effective manner when inverted.

Direct drive power cylinders are employed in the prior art whereby their full hydraulic capacity is used when driving piers. While this is the most efficient manner for driving piers, the assembly hardware for installing the power cylinders can be extremely heavy and unwieldy in the field. The efficiency of workers who must install the apparatus to the piers and supported foundation must be taken into consideration; a lighter power cylinder assembly would lead to faster installations, while causing less fatigue and injuries to the worker. It would be advantageous to have an apparatus for easily and quickly mounting a power cylinder to an assembly for driving a pier into the ground adjacent a footing to be supported.

SUMMARY OF THE INVENTION

The present invention utilizes a cylinder mounting beam assembly that allows hydraulic cylinders to be positioned within the installation apparatus such that they can utilize their full capacity when driving piers. The cylinder mounting beam assembly is adapted to be used in connection with currently existing pier driving apparatuses of the type which provide for placement of two offset hydraulic cylinders that straddle the pier. The pistons of the hydraulic cylinders are connected to a clamping member which grips the pier for urging the pier into the ground. This type of pier driving apparatus further has driving arm members, against which the power cylinders are indirectly braced, which engage the footing, such as through a bracket or other load transfer mechanism placed underneath the footing.

The invention comprises a planar pier retaining member having a central opening for receiving the pier and has connection points for attachment to the driving arm members of the pier driving apparatus. The planar pier retaining member is further comprised of plate members upon which the hydraulic cylinders are mounted. Openings are placed in the plate members so that the piston rods of the hydraulic cylinders extend through and below the plate members, whereupon they connect with the clamping members which engage the pier to be driven. In this arrangement, the hydraulic cylinders are able to drive the pier utilizing the push stroke of the piston rod instead of the back stroke. The plate members are capable of disassembly, so that the mounting beam assembly may be broken down into separate components. This arrangement allows the pier driving process of the footing supporting operation to proceed much more efficiently in that the mounting beam assembly is of a reduced weight, making it easier for the worker to lift, and also because installation of the mounting beam assembly can be done laterally around the pier rather than sliding down over the top of the pier.

It is therefore an object of the invention to provide a hydraulic cylinder mounting beam assembly which can be used in connection with existing foundation supporting bracket assemblies. It is a further object of the invention to provide a hydraulic cylinder mounting beam assembly which is capable of mounting the hydraulic cylinders in such a way that the direct power stroke of the piston rods is utilized. It is still further an object of this invention to provide a hydraulic cylinder mounting beam assembly which is capable of disassembly into component parts.

The above features are objects of this invention. Further objects will appear in the detailed description which follows and will be otherwise apparent to those skilled in the art.

For purpose of illustration of this invention preferred embodiments are shown and described hereinbelow in the accompanying drawing. It is to be understood that this is for the purpose of example only and that the invention is not limited thereto.

DESCRIPTION OF THE INVENTION

Figure 3:
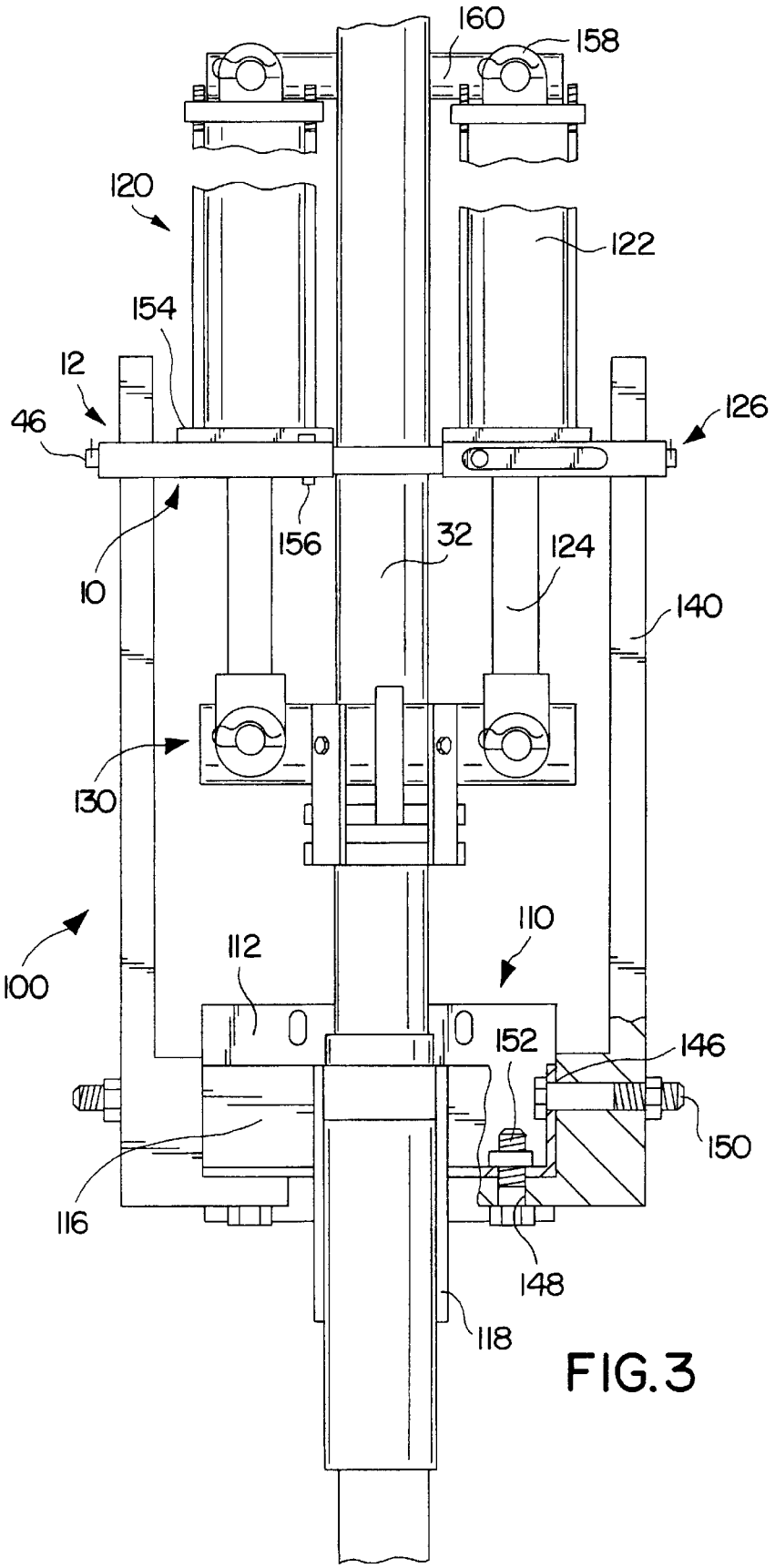
FIG. 3 is a front view of a pier driving assembly utilizing the cylinder mounting beam assembly shown with a pier section and load transfer mechanism.
Figure 4:
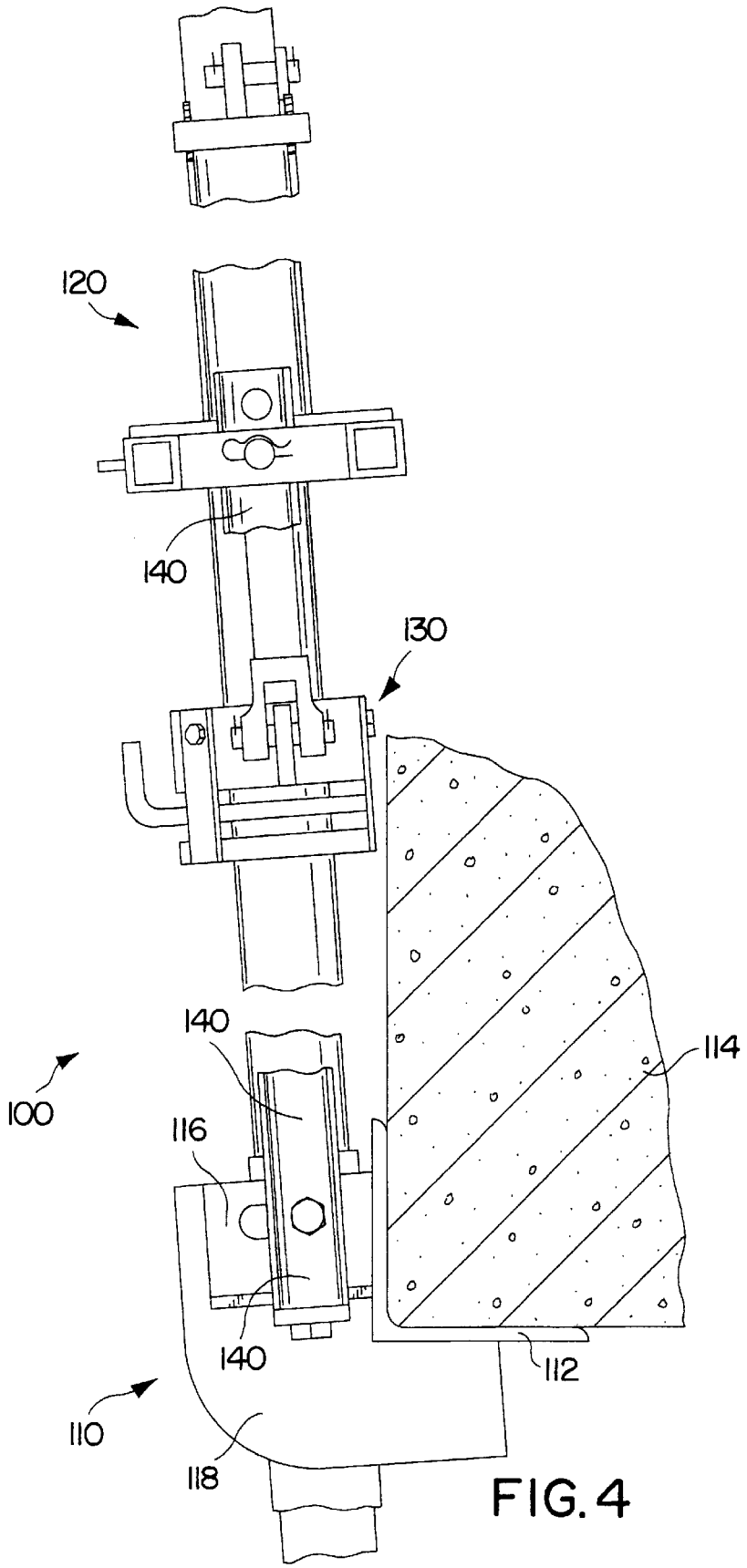
FIG. 4 is a side view, partially broken away, of the pier driving assembly utilizing the cylinder mounting beam assembly shown with a pier section and load transfer mechanism.

The invention comprises an improvement to apparatuses of the type used for driving piers into the ground for supporting a building foundation or footing. This type of apparatus indicated by the reference numeral 100 is generally known to those having skill in the art and is shown in FIGS. 3 and 4 modified to incorporate the invention. For an understanding of how the instant invention is employed, a brief description of the pier installation apparatus is provided herewith. As this type of apparatus is understood by those skilled in the art, certain standard components are shown partially broken away.

The typical pier installation apparatus 100 is comprised of a footing engaging bracket assembly 110, hydraulic driving elements 120, pier clamp 130, and a pair of driving assembly arms 140. The footing engaging bracket assembly is comprised of an L-shaped member 112 upon which a footing 114 is supported, a load transferring bracket 116 and pier guide plates 118. The hydraulic driving elements 120 are comprised of hydraulic jack cylinders 122 which have an extending piston rod 124 that engage pier clamp 130. The jack cylinders 122 are mounted on or from an element 126 that engages driving assembly arms 140 which in turn are braced against load transferring bracket 116. To drive a pier into the ground, piston rods 124 are extended, which causes pier clamp 130 to grip the pier. Pier clamps may be of either the type that are manually closed around the pier, or, alternately, a slip clamp that engages the pier upon a downward stroke of the piston and releases upon retraction. Because the hydraulic driving elements 120 are braced against the foundation footing 114 through bracket assembly 110, a downward driving force is exerted upon the pier. After the piston rods 124 have reached their full extended range, the clamp 130 is released from the pier, and the piston rods are retracted back to their pre-load condition for the next driving cycle. This process is well-known in the art and itself forms no part of the invention per se.

Figure 1:
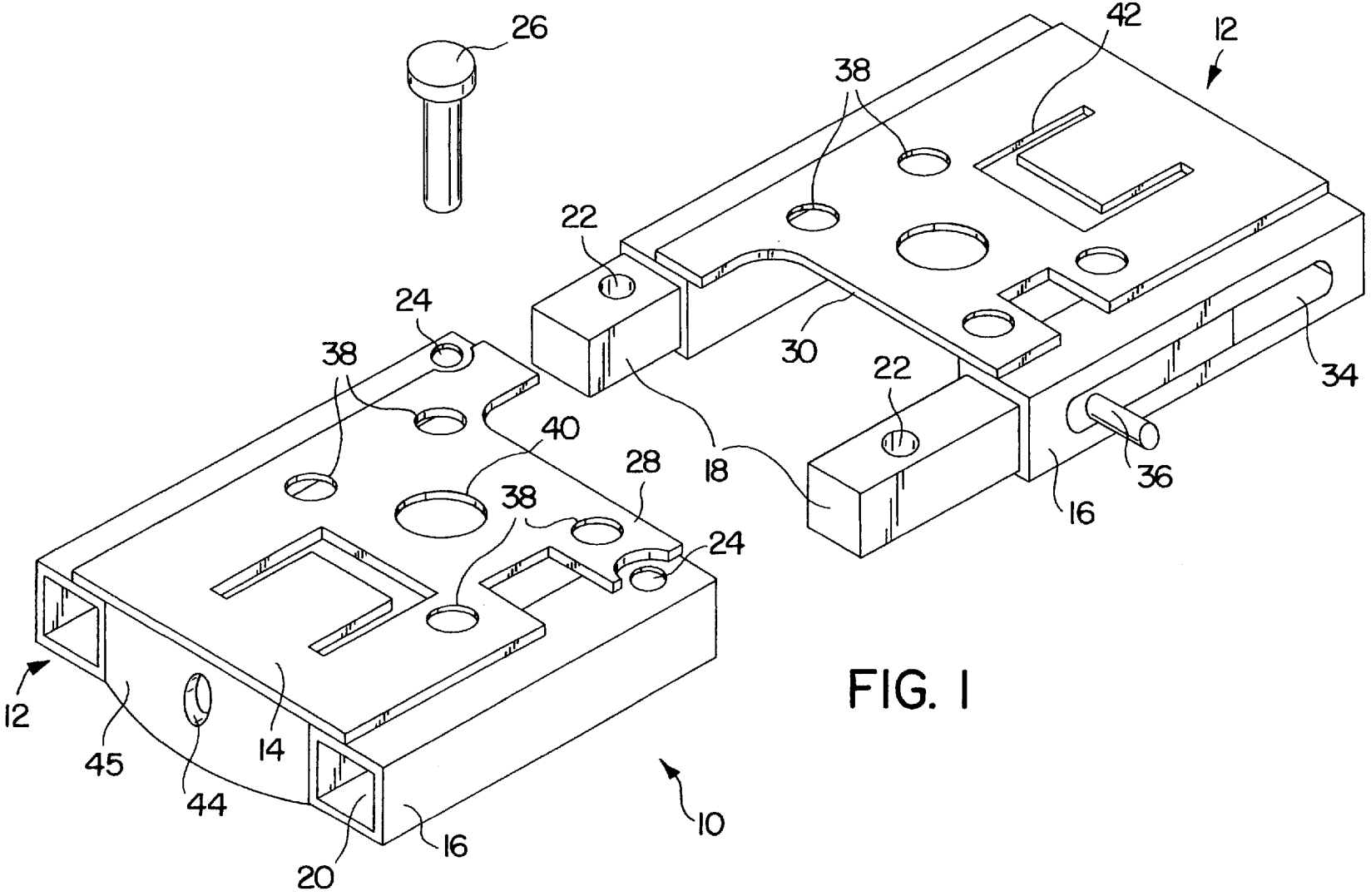
FIG. 1 is a perspective view of one embodiment of the cylinder mounting beam assembly.

The instant invention relates to an improvement to the manner of mounting the hydraulic cylinders to the pier installation apparatus. It comprises a planar mounting beam assembly and is generally referred to by the reference numeral 10 as shown in FIG. 1, which shows a first embodiment of the invention. Beam assembly 10 is formed from a pair of opposing, co-planar mounting plate members 12 that are optimally formed, for providing rigidity to the assembly, from steel plates 14 with reinforced lateral sides 16 formed from square bar stock or hollow metal tubing, interconnected by means of welds, or can be formed of one piece. The mounting plate members 12 are separable from each other, and are joined together by insertion of square bar stock members or dowels 18 extending from one plate member into the opening 20 of hollow metal tubing 16 of the other plate member as shown in FIGS. 1 and 3. Dowel 18 is provided with a hole 22 which is brought into alignment with hole 24 in metal tubing 16 so that locking pin 26 may be inserted therein to secure the respective mounting plates together. If desired, one end of the dowel may be welded within the hollow metal tubing of one plate member, so that it leaves only one free end to be secured. Alternately, dowel 18 may slide freely within the hollow tubing of both plate members with holes 24 being provided in both plate members. Recessed areas 28 and 30 are formed into steel plates 14 such that a gap remains for pier 32 to pass through. A plurality of holes spaced incremently apart (not shown) may be provided in dowel member 18 (or metal tubing 16) so that the dimensions of the gap may be adjusted to accommodate various size piers.

To make the connection process more efficient, hollow metal tubing 16 has a slot 34 formed therein along its exterior lateral side, and dowel 18 is provided with a finger member 36 which extends through slot 34 to enable a sliding breech bolt action of the dowel within the hollow tubing. One or both lateral sides of the mounting plate member 12 may be equipped with the sliding breech bolt dowel; however, only one side need be so constructed because lateral installment of the mounting beam assembly only requires that one side of the assembly to be open to receive the pier. This lateral installment capability is especially advantageous when the installation apparatus is used in confined areas, where overhead clearance is limited so that it would be difficult to place a power cylinder mounting beam over the top of the extended pier.

The cylinder mounting beam assembly functions as a mounting platform for the hydraulic cylinders, and as a reaction beam from which driving force of the piers is exerted. Steel plate 14 is provided with a plurality of holes 38 to receive mounting bolts for securing- hydraulic cylinder jacks 122 to mounting plate members 12. Central opening 40 in plate 14 allows piston rod 124 to depend down below the mounting beam assembly to engage the pier clamping mechanism 130. Slots 42 are further provided in plate 14 to receive driving arm members 140, which are secured to the mounting plate by bolts or clevis pins through hole 44 provided in end plate 45. Alternate connection methods of attachment of the driving arm members 140 to the mounting plate can also be employed, such as connecting the driving arms to the outer side of the mounting plate.

Figure 2:
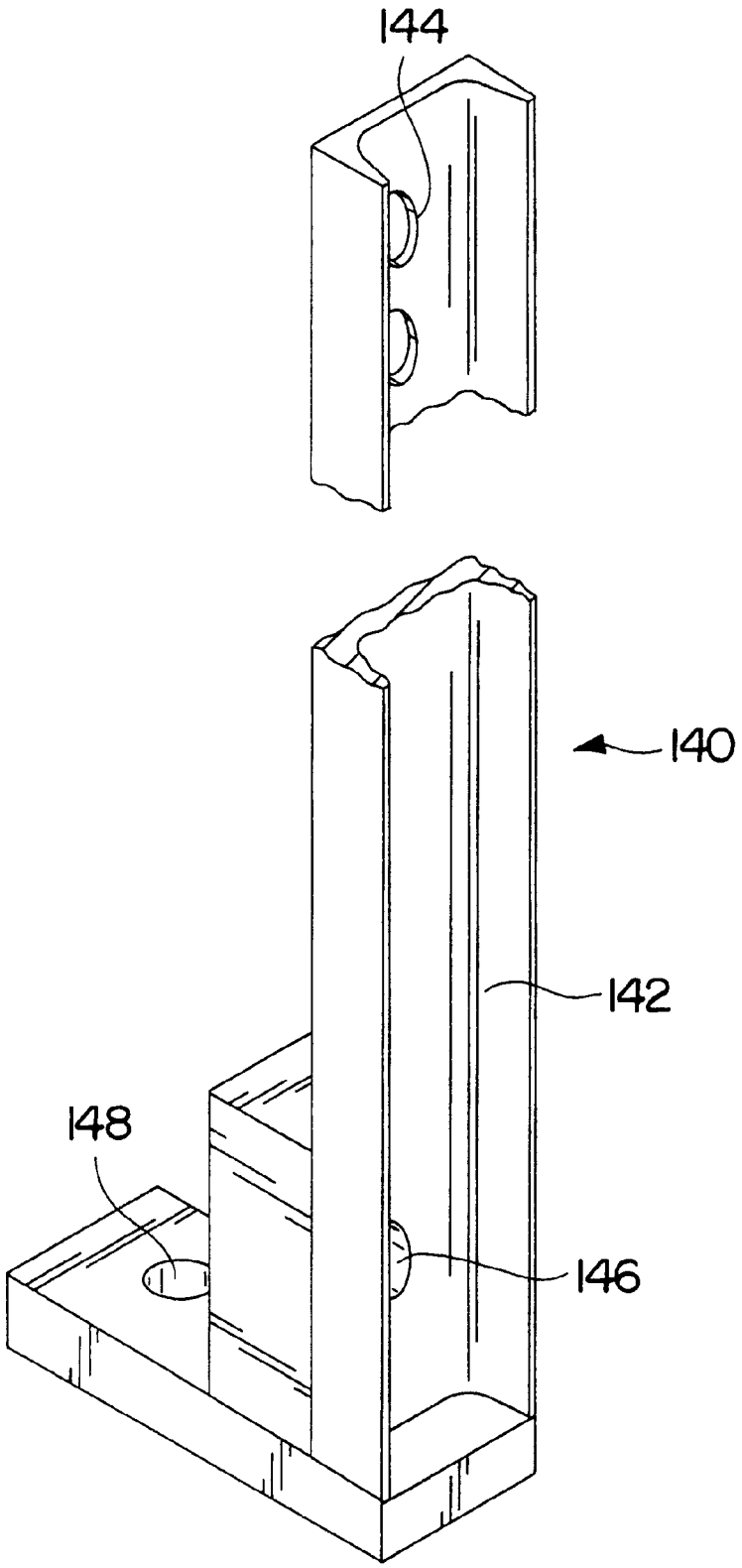
FIG. 2 is a perspective view of a driving assembly arm member which is used to brace the cylinder mounting beam assembly against a foundation load transfer assembly.

FIGS. 3 and 4 show the cylinder mounting beam assembly in operation with the pier driving apparatus. After the assembly 10 is placed around pier 32, and prior to mounting the power cylinders 122, the mounting plate members 12 are connected to each other by manipulation of the breech action of dowel member 18 as discussed above. The driving arm members 140 pass through the slots 42 of the mounting plates and are connected by bolt or pin 46 through hole 44. FIG. 2 shows the general structure of driving arm member 140 which is comprised of an elongated shaft 142 which spans the distance between mounting beam assembly 10 and footing engaging bracket assembly 110. For enhanced strength and rigidity, driving arm member 140 is C-shaped in cross-section. Slot 42 in mounting plate member 12 has a corresponding C-shaped channel to receive arm member 140. A plurality of holes 144 may be provided at the top of arm member 140 to allow the cylinder mounting beam assembly to be positioned on the pier at the optimum elevation that will allow the maximum stroke of the hydraulic piston rods. Holes 146 and 148 are provided at the bottom of arm 140 for connection to load transfer bracket 116 by bolts or pins 150 and 152, respectively.

Hydraulic jack cylinders 122 are provided with a bottom flange plate 154 having holes for lining up with holes 38 on mounting plate 12 and securing thereto by bolts 156. Piston rod 124 of jack 122 extends through central opening 40 of mounting plate 12 whereupon it is connected to clamping assembly 130 in a manner well known to those skilled in the art. For added stability, jacks 122 may be provided with clevis end members 158 to receive cross brace member 160. The cross brace maintains near vertical alignment of the jack cylinders, preventing them from leaning forward or spreading apart which could adversely affect the efficiency of the pier driving process.

Figure 5:
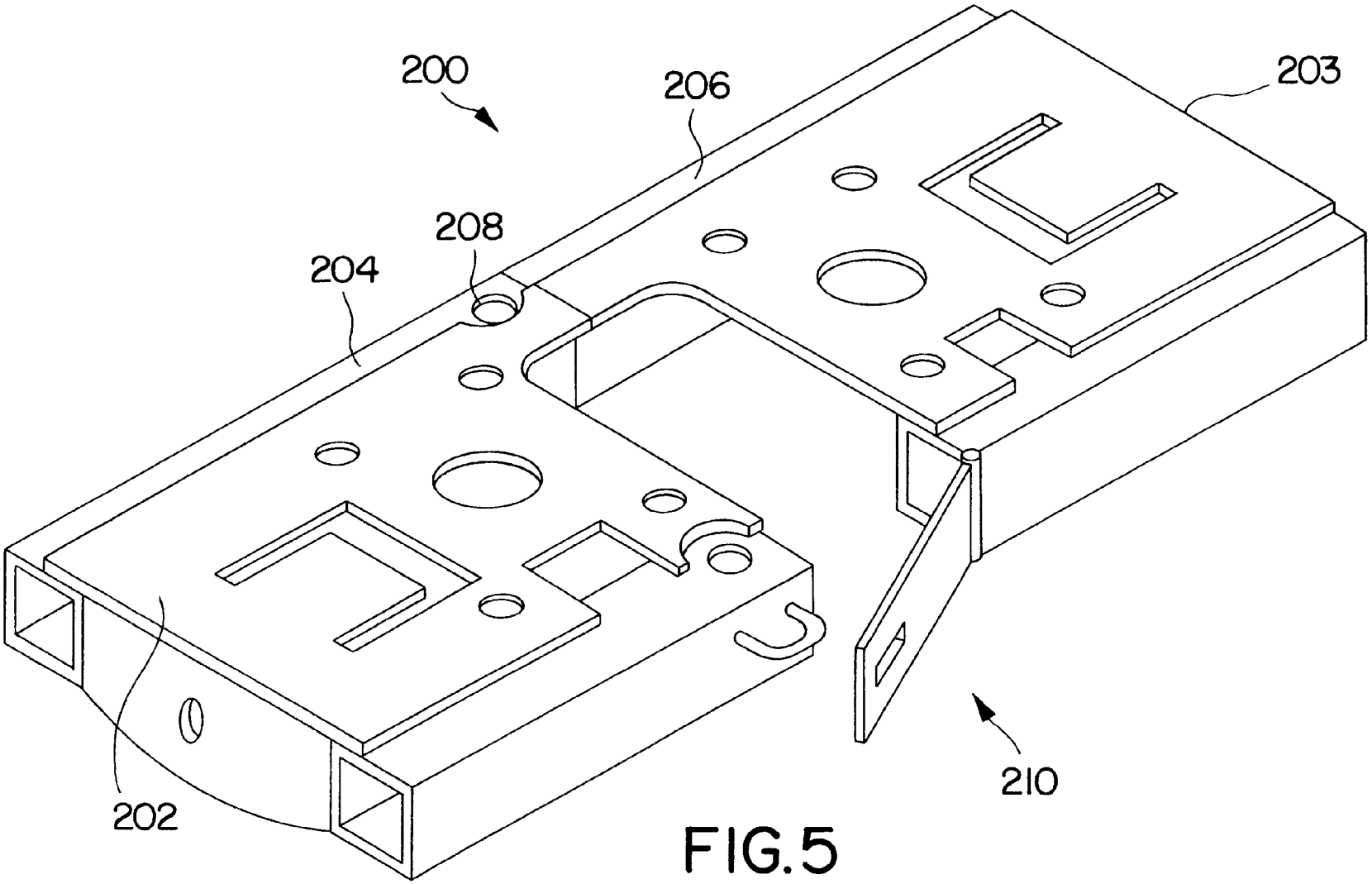
FIG. 5 is a perspective view of a further embodiment of the cylinder mounting beam assembly.

FIG. 5 shows another embodiment 200 of the invention which is somewhat similar in construction to that shown in FIG. 1. In this embodiment, connection of the mounting plate members 202 and 203 to each other is effected through a hinged relationship. Lateral side 204 is formed from hollow square tubing and receives an extended tongue element (not shown) of lateral side 206 which serves to engage the opposing mounting plates to each other. Holes 208 are provided in each of lateral side 204 and the extended tongue element for alignment therebetween for insertion of a connection pin 26, such as in FIG. 1, whereupon a hinged relationship between the mounting plates is created. The mounting plates are swung open along their common plane to receive the pier. A fastener such as hasp 210 is provided so that the mounting plate assembly may be closed around the pier.

Figure 6:
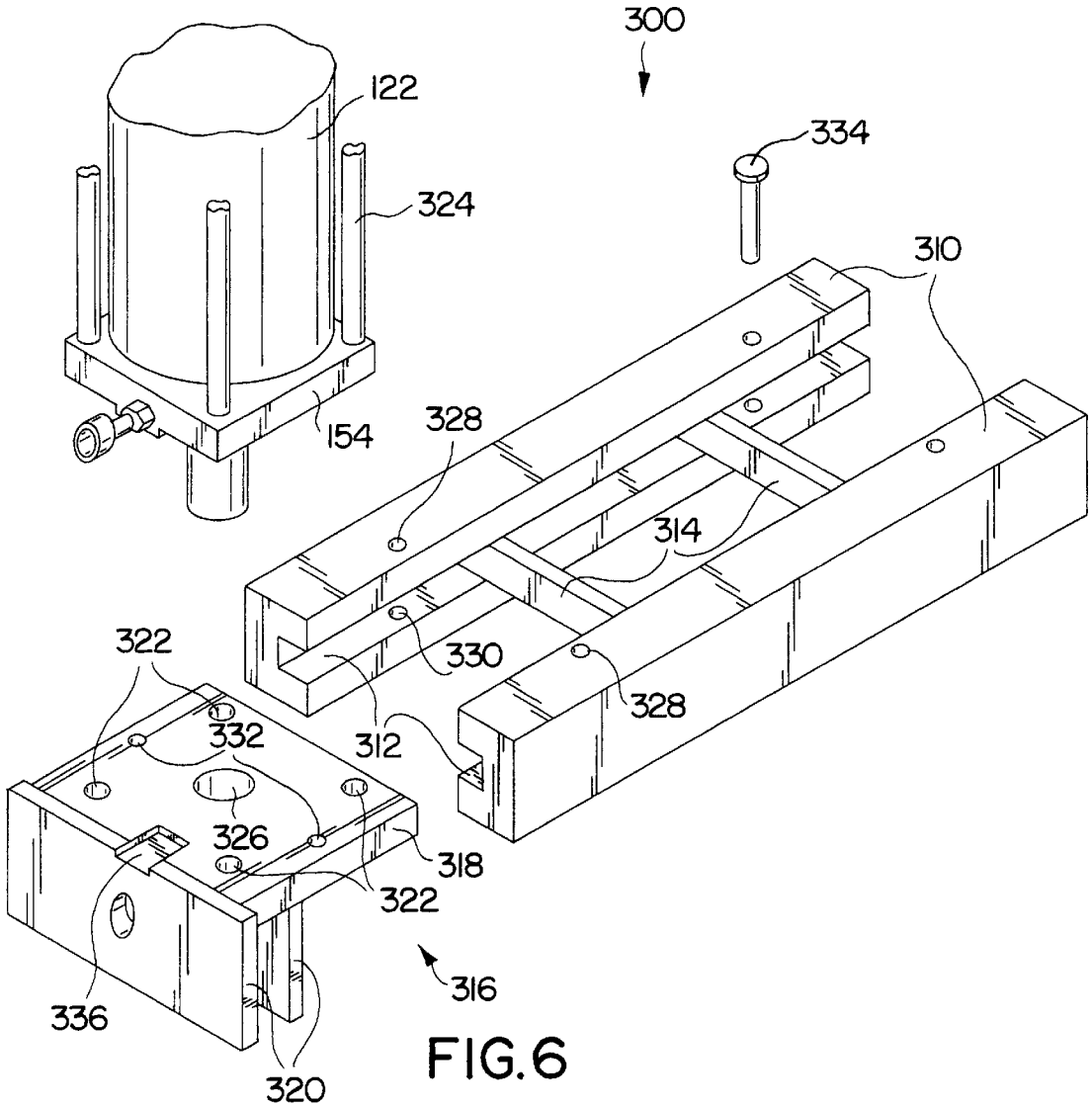
FIG. 6 is a perspective, partially exploded view of another embodiment of the cylinder mounting beam assembly.

FIG. 6 shows another embodiment 300 of the mounting beam assembly. It comprises a pair of parallel, spaced-apart elongated rail members 310 cut from heavy gauge steel plate, each having a longitudinal channel 312 formed along an interior edge thereof. A pair of spacer bars 314 hold rail members 310 parallel to each other and provide structural strength. Two mounting plate members 316 (of which only one is shown) are provided for mounting the power cylinder 122. Each is comprised of a flat steel plate 318 having a pair of depending spaced apart end plates 320. Steel plate 318 is provided with a plurality of holes 322 for receiving mounting bolts 324 to secure power cylinder onto the mounting plate. Central opening 326 allows the piston rod to depend down below the mounting beam assembly to engage the pier clamping mechanism as shown in FIGS. 3 and 4. Prior to mounting the power cylinders, each mounting plate member 316 is connected to the rail members 310 by sliding plate 318 within channels 312. Corresponding holes 328 and 330 on the rails and 332 on steel plate 318 are brought into alignment for receiving a fastener 334 therethrough. End plates 320 remain external of the rails to accommodate the driving arm members through slot 336. Through this arrangement, the various component parts of the cylinder mounting beam assembly can be broken down. Thus, the weight of the equipment that must be handled by field personnel is greatly reduced. This allows the hydraulic cylinders to be readily removed and reinstalled in the field, thereby increasing the efficiency of the pier installation process.

Various changes and modifications may be made within this invention as will be apparent to those skilled in the art. Such changes and modifications are within the scope and teaching of this invention as defined in the claims appended hereto.

What is claimed is:

1. In an apparatus for driving piers into the ground for a purpose of supporting a foundation structure, said apparatus comprising at least two hydraulic driving elements disposed in an offset position adjacent a pier, said hydraulic driving elements having means for gripping said pier, said hydraulic driving elements being braced against a member having driving arm members in connection with said foundation, said pier being able to be driven into the ground by actuation of said hydraulic driving element such that a downward driving force is applied to said pier, an improvement comprising a hydraulic driving element mounting beam assembly, said mounting beam assembly comprising a planar pier retaining member having a central opening for receiving said pier perpendicularly therethrough, and means for receiving said driving arm members, said pier retaining member comprising a pair of opposing hydraulic driving element mounting plate members, said hydraulic driving element mounting beam assembly being capable of disassembly such that each one of said respective pairs of said hydraulic driving element mounting plate members are separable from each other, whereby lateral attachment of said hydraulic driving element mounting beam assembly around said pier is enabled.

2. The apparatus of claim 1 in which each of said hydraulic driving element mounting plate members has an aperture, said mounting plate members being disposed on said mounting beam assembly to receive thereupon a hydraulic driving element, with a piston of said hydraulic driving element depending below said mounting plate member through said aperture.

3. The apparatus of claim 2 in which said hydraulic driving element mounting plate members have lateral edges forming elongated, hollow tubular members, said tubular members being adapted to receive a dowel member therein when said pairs of mounting plate members are aligned around said pier, whereby joining of said mounting plate members is effected.

4. The apparatus of claim 3 in which said dowel member is slidably receivable in said hollow tubular members, at least one of said hollow tubular members having formed in a side wall therein an elongated slot, said dowel member having a finger member extending through said slot, whereby said dowel member is moveable within said hollow tubular members by manipulation of said finger member.

5. The apparatus of claim 3 in which said dowel member is provided with at least one hole, and at least one of said hollow tubular members is provided with at least one reciprocal hole, said hole of said dowel member and one of said at least one reciprocal hole being capable of alignment such that a fastener is receivable through said alignment of holes for connecting said hydraulic driving element mounting plate members.

6. The apparatus of claim 5 in which said at least one of said hollow tubular members is provided with a plurality of reciprocal holes arranged an incremental distance from each other along a length of said tubular member, whereby adjustment to an effective pier-accommodating diameter of said central opening can be effected.

7. The apparatus of claim 2 in which said hydraulic driving element mounting plate members are hingedly connected such that said mounting plate members are swung open along their common plane to receive therebetween said pier.

8. The apparatus of claim 7 in which an end of one of said mounting plate members has an extended engagement member, said engagement member being connected in hinged relationship to an opposing end of other of said mounting plate members, said apparatus having a fastener to effect connection of said mounting plate members around a pier.

9. The apparatus of claim 8 in which said fastener comprises a hasp member disposed alongside said mounting plate members.

10. The apparatus of claim 2 in which each of said hydraulic driving element mounting plate member has a channel for receiving transversely therethrough said driving arm members, fasteners being provided for securing said driving arm members to said mounting plate members.

11. The apparatus of claim 2 in which a cross brace member spans between and is connected to top ends of said hydraulic driving elements to prevent their lateral sway.

12. In an apparatus for driving piers into the ground for a purpose of supporting a foundation structure, said apparatus comprising at least two hydraulic driving elements disposed in an offset position adjacent a pier, said hydraulic driving elements having means for gripping said pier, said hydraulic driving elements being braced against a member having driving arm members in connection with said foundation, said pier being able to be driven into the ground by actuation of said hydraulic driving element such that a downward driving force is applied to said pier, an improvement comprising a hydraulic driving element mounting beam assembly, said mounting beam assembly comprising a planar pier retaining member having a central opening for receiving said pier perpendicularly therethrough, and means for receiving said driving arm members, said retaining member comprising a pair of opposing hydraulic driving element mounting plate members, said hydraulic driving element mounting beam assembly being capable of disassembly such that each one of said respective pairs of said hydraulic driving element mounting plate members are separable from each other.

13. The apparatus of claim 12 in which said pier retaining member further comprises a pair of parallel, spaced-apart elongated rail members each having a longitudinal channel formed along an interior edge thereof, said longitudinal channels slidably receiving therein said hydraulic driving element mounting plate members.

14. The apparatus of claim 12 in which each of said hydraulic driving element mounting plate members has an aperture, said mounting plate members being disposed in said mounting beam assembly to receive thereupon a hydraulic driving element, with a piston of said hydraulic driving element depending below said mounting plate member through said aperture.

15. The apparatus of claim 14 in which each of said hydraulic driving element mounting plate member has a slot for receiving transversely therethrough said driving arm members, fasteners being provided for securing said driving arm members to said mounting plate members.

16. The apparatus of claim 14 in which a cross brace member spans between and is connected to top ends of said hydraulic driving elements to prevent their lateral sway.

* * * * *